US007131854B1

(12) United States Patent
Pavlovic et al.

(10) Patent No.: US 7,131,854 B1
(45) Date of Patent: Nov. 7, 2006

(54) ELECTRICAL CONNECTOR AND AIRBAG APPARATUS HAVING AN ELECTRICAL CONNECTOR

(75) Inventors: Slobadan Pavlovic, Canton, MI (US); David Menzies, Clawson, MI (US)

(73) Assignee: Lear Corporation, Southfield, MI (US)

( * ) Notice: Subject to any disclaimer, the term of this patent is extended or adjusted under 35 U.S.C. 154(b) by 0 days.

(21) Appl. No.: 11/162,175

(22) Filed: Aug. 31, 2005

(51) Int. Cl.
*H01R 13/62* (2006.01)

(52) U.S. Cl. ..... 439/352

(58) Field of Classification Search ..... 439/352, 439/353, 358, 357
See application file for complete search history.

(56) References Cited

U.S. PATENT DOCUMENTS

| | | | | |
|---|---|---|---|---|
| 5,529,512 | A * | 6/1996 | Mlyniec | 439/352 |
| 5,688,141 | A * | 11/1997 | Dullin | 439/352 |
| 5,772,460 | A * | 6/1998 | Baumann | 439/352 |
| 5,816,840 | A * | 10/1998 | Dullin | 439/352 |
| 5,853,298 | A * | 12/1998 | Pacher | 439/352 |
| 6,341,972 | B1 * | 1/2002 | Odorfer | 439/352 |
| 6,530,799 | B1 * | 3/2003 | Regnier et al. | 439/352 |
| 6,533,601 | B1 | 3/2003 | Raudenbush et al. | |
| 6,544,060 | B1 * | 4/2003 | Wakui et al. | 439/188 |
| 6,595,793 | B1 * | 7/2003 | Tsuji et al. | 439/352 |
| 6,699,059 | B1 * | 3/2004 | Nagamine et al. | 439/352 |
| 6,716,052 | B1 | 4/2004 | Kane | |
| 6,726,495 | B1 * | 4/2004 | Hirschmann | 439/188 |
| 6,780,045 | B1 | 8/2004 | Shuey et al. | |
| 6,811,424 | B1 * | 11/2004 | Seminara et al. | 439/352 |
| 6,817,883 | B1 | 11/2004 | Raudenbush et al. | |
| 6,824,417 | B1 * | 11/2004 | Nimura | 439/352 |
| 6,866,534 | B1 * | 3/2005 | Hirschmann | 439/352 |
| 6,881,103 | B1 | 4/2005 | Dawidziuk | |
| 6,893,277 | B1 * | 5/2005 | Parrish et al. | 439/188 |
| 6,918,783 | B1 * | 7/2005 | Endo et al. | 439/352 |
| 2005/0009390 | A1 | 1/2005 | Barker et al. | |

* cited by examiner

*Primary Examiner*—Gary F. Paumen
(74) *Attorney, Agent, or Firm*—Brooks Kushman P.C.

(57) ABSTRACT

An electrical connector includes a first connector housing which is configured to cooperate with a second connector housing in a mated position to facilitate making an electrical connection. A connector position assurance device (CPA) is configured to cooperate with the first connector housing in a first position to allow engagement and disengagement of the first and second connector housings. The CPA has a second position which inhibits disengagement of the first and second connector housings from the mated position. The CPA also includes a locking feature configured to engage the first connector housing to inhibit unseating of the CPA. The CPA also includes a release mechanism which is operable from outside the first connector housing, and allows the locking feature to be disengaged from the first connector housing to facilitate unseating of the CPA.

20 Claims, 4 Drawing Sheets

ELECTRICAL CONNECTOR AND AIRBAG APPARATUS HAVING AN ELECTRICAL CONNECTOR

BACKGROUND OF THE INVENTION

1. Field of the Invention

The present invention relates to an electrical connector and a vehicle airbag apparatus having an electrical connector.

2. Background Art

Electrical connectors, and in particular, plug-type electrical connectors, can provide a fast and convenient way to connect and disconnect electrically operated devices. In the case of a plug-type connector, it may be necessary for the two portions of the plug—e.g., the male and female portions—to be fully seated to ensure an adequate electrical connection. One way to help ensure that two portions of an electrical connector are fully seated with each other, is through the use of a connector position assurance device (CPA).

A CPA can be configured such that it cooperates with the electrical connector to provide a visual assurance that the connector is fully seated. For example, a CPA may have seated and unseated positions which are readily discernible by visual inspection. The CPA can be configured such that it cannot be moved from the unseated to the seated position unless the two portions of the connector are fully seated with each other. Moreover, a CPA can be configured so that the two portions of the connector cannot be disengaged as long as the CPA remains in its seated position.

One such CPA is described in U.S. Pat. No. 6,780,045 issued to Shuey et al. on Aug. 24, 2004. Shuey et al. describes a connector position assurance device which can be used in an electrical connector assembly to help ensure that two portions of the electrical connector are fully engaged with each other. The CPA described in Shuey et al. is configured so that the two connector portions cannot be readily disengaged if the CPA is in its fully seated position.

One limitation of the CPA described in Shuey et al. is that it can be dislodged from its fully seated position merely by applying an extraction force to the CPA. Although it contains a protrusion to provide a small amount of resistence to movement from its fully seated position, the protrusion is specifically configured with a sloped surface which allows the CPA to be readily disengaged from the connector. Thus, it may be possible for the CPA described in Shuey et al. to become unintentionally disengaged from the electrical connector, while the connector is in service.

Disengagement of a CPA while the connector is in service may be particularly problematic in certain applications where the electrical connector is subjected to relatively large forces. For example, in the case of a vehicle airbag, the electrical connection at the airbag initiator may encounter large forces when the airbag deploys. Moreover, some airbags are configured for a two-stage deployment such that the electrical connection at the airbag initiator must be maintained after the first stage of deployment, to ensure that the second stage will not be inhibited.

Although it is clear that the electrical connector at an airbag initiator must itself remain engaged to ensure proper initiation of the airbag, it may also be necessary for the CPA to remain in its seated position for the initiator to properly function. This is because airbag initiators may be configured with a service safety feature which does not allow the initiator to function unless the electrical connector is fully engaged and the CPA is fully seated. A built-in short circuit may be configured into the electrical circuit of the airbag initiator, such that the short circuit is opened only when the CPA is in its fully seated position. Thus, even a small amount of movement of the CPA out of its fully seated position will allow the short circuit to close, thereby disabling the initiator. Therefore, in airbag initiators which include this type of built-in short circuit safety feature, and are also configured to deploy an airbag in two stages, it is particularly important that the CPA remain seated after the first stage of deployment to ensure that the airbag will properly deploy during the second stage.

Accordingly, it would be desirable to have an electrical connector with a connector position assurance device which was not readily unseated from the connector. In particular, it would be desirable to have a CPA which did not readily disengage from the connector merely by applying an extraction force to the CPA.

SUMMARY OF THE INVENTION

The present invention provides an electrical connector including a connector position assurance device which has a locking mechanism to help maintain the CPA in its seated position. The locking mechanism will not readily disengage from the connector merely by applying an extraction force to the CPA. The CPA also includes a release mechanism which requires application of a force other than an extraction force to disengage the locking mechanism and facilitate removal of the CPA.

The invention also provides an electrical connector including a first connector housing configured to cooperate with a second connector housing in a mated position to facilitate the making of an electrical connection. The electrical connector includes a retainer configured to cooperate with a first connector housing in a first retainer position to allow engagement and disengagement of the first and second connector housings with each other. The retainer is further configured to cooperate with at least one of the connector housings in a second retainer position to inhibit disengagement of the first and second connector housings from the mated position. The retainer includes a first locking feature configured to engage the first connector housing when the retainer is in the second retainer position. This inhibits movement of the retainer out of the second retainer position. The retainer also includes a release mechanism operable from outside the first connector housing to disengage the first locking feature from the first connector housing to facilitate movement of the retainer out of the second retainer position.

The invention further provides an electrical connector including a first connector housing configured to be engaged with a second connector housing in a mated position to facilitate the making of an electrical connection. The electrical connector includes a connector position assurance device positionable in a seated position for inhibiting disengagement of the connector housings from the mated position. The CPA includes at least one locking tab positionable in first and second positions when the CPA is in the seated position. When the at least one locking tab is in the first position, it engages the first connector housing to inhibit movement of the CPA out of the seated position. When the at least one tab is in the second position, it is disengaged from the first connector housing to facilitate movement of the CPA out of the seated position. The locking tab is movable from the first position to the second position by application of a predetermined force on a portion of the CPA disposed outside the first connector housing.

The invention also provides a vehicle airbag apparatus which includes an initiator having an initiator connector housing attached thereto. A first connector housing is configured to cooperate with the initiator connector housing in a mated position for making an electrical connection with the initiator. A retainer is movable between first and second retainer positions. The first retainer position facilitates movement of the first connector housing into and out of the mated position. The second retainer position inhibits movement of the first connector housing out of the mated position. The retainer includes a locking feature configured to engage the first connector housing to inhibit movement of the retainer out of the second retainer position. The locking feature is at least partially disengageable from the first connector housing to facilitate movement of the retainer out of the second retainer position.

DETAILED DESCRIPTION OF THE PREFERRED EMBODIMENT(S)

Figure 1:
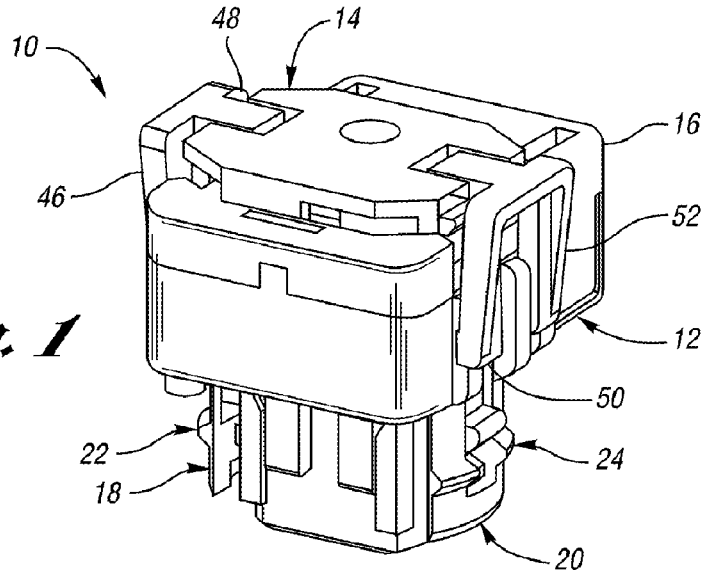
FIG. 1 is a perspective view of an electrical connector in accordance with one embodiment of the present invention.

FIG. 1 shows an electrical connector 10 in accordance with one embodiment of the present invention. The connector 10 includes a first connector housing 12 and a retainer, or connector position assurance device 14, which, as shown in FIG. 1, is in a first retainer position. The first connector housing 12 includes a cover 16 which can be used to cover electrical connections (not shown) inside the first connector housing 12. The first connector housing 12 also includes first and second locking legs 18, 20, which, as explained more fully below, are configured to mate with a second connector housing to facilitate making of an electrical connection. In particular, each of the locking legs 18, 20 includes locking bumps 22, 24 which are received by a slot inside the second connector housing.

Figure 2:
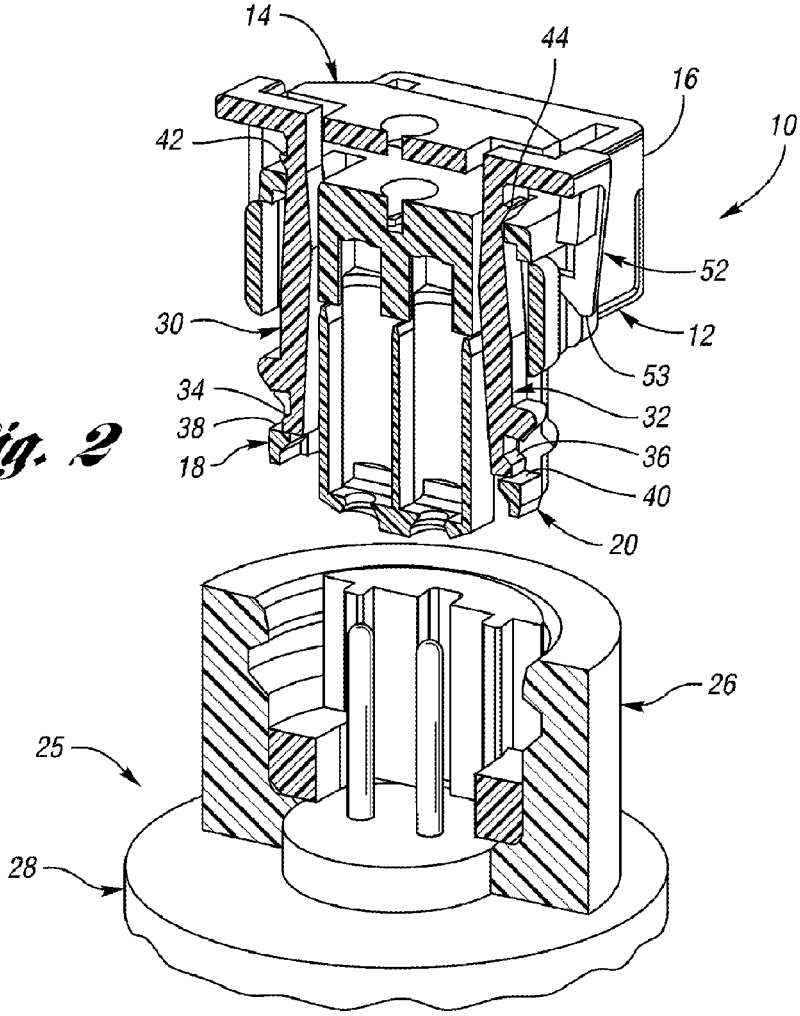
FIG. 2 is a partial fragmentary sectional view of the electrical connector shown in FIG. 1 and a vehicle airbag apparatus including an airbag initiator with an initiator connector housing.

FIG. 2 shows a sectional view of the electrical connector 10, and also shows a vehicle airbag apparatus 25, including a sectional view of a second connector housing, or initiator connector housing 26. The initiator connector housing 26 provides an electrical connection for power and control signals to an airbag initiator 28. As shown in FIG. 2, the CPA 14 includes first and second beams 30, 32. Disposed near a distal end of each of the beams 30, 32 are rests 34, 36. The rests 34, 36 cooperate with corresponding portions 38, 40 of the first connector housing 12 to inhibit movement of the CPA 14 into a second retainer position, or seated position, while the first connector housing 12 is disengaged from the initiator connector housing 26. The portions 38, 40 of the first connector housing 12 form a portion of the locking legs 18, 20, and cooperate with the rests 34, 36 so that the CPA 14 must be subjected to a force of at least 60 Newtons (N) in order to seat it when the connector housings 12, 26 are disengaged. Disposed near a proximal end of each of the beams 30, 32 are locking features, or locking tabs 42, 44. As described more fully below, the locking tabs 42, 44 inhibit movement of the CPA 14 from the second retainer position—i.e., they help to keep the CPA 14 in a seated position even in the presence of extraction forces.

Just as the CPA 14 includes rests 34, 36 which keep it from prematurely moving downward, the CPA 14 is also configured to stay attached to the first connector housing 12 prior to installation. As shown in FIG. 1, the CPA 14 includes locking arms 46, 48, 50, 52. Each of the locking arms 46–52 cooperates with the first connector housing 12 to keep the CPA from being inadvertently dislodged. In the sectional view shown in FIG. 2, the arm 52 is shown having latch 53 which engages the first connector housing 12. Although not shown, it is understood that the other locking arms 46–50 also include latches to help secure the CPA 14 to the first connector housing 12.

Figure 3:
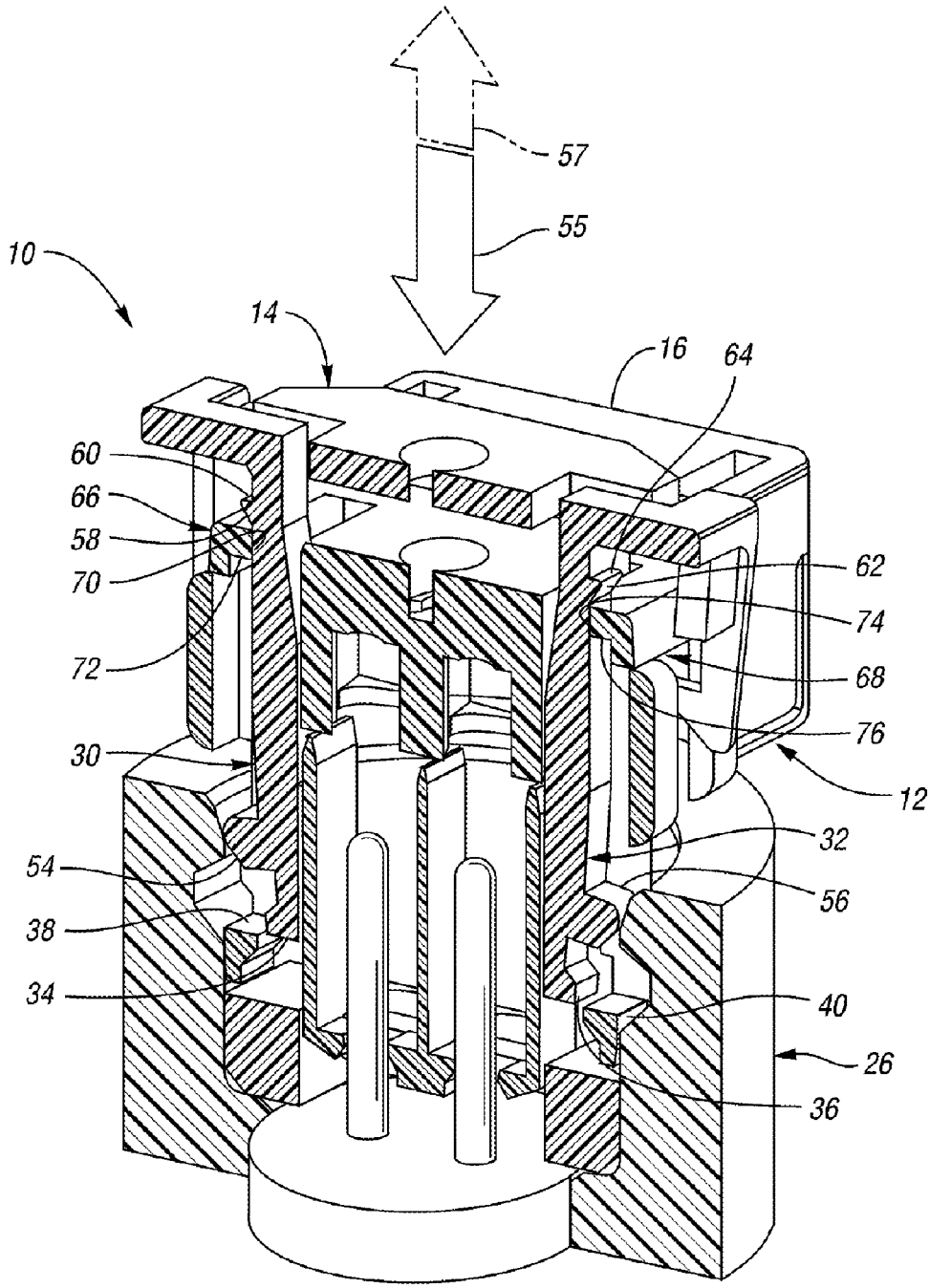
FIG. 3 is a sectional view of the electrical connector and initiator connector housing partially engaged.

FIG. 3 shows a sectional view of the electrical connector 10 as the first connector housing 12 begins to engage the initiator connector housing 26. In order to engage the two connector housings 12, 26, a force is applied to the CPA 14 in a first direction, indicated by the directional arrow 55. Shown in phantom in FIG. 3 is a second directional arrow 57, indicating a second direction opposite the first direction. The directional arrow 57 indicates the direction of an extraction force which, for example, could be encountered by the electrical connector 10 during deployment of an airbag.

As shown in FIG. 3, near the distal end of each of the beams 30, 32 is a protrusion 54, 56. The protrusions 54, 56 have generally sloped and/or rounded edges which cooperate with similarly sloped and/or rounded edges on the initiator connector housing 26. Thus, as a force is applied to the CPA 14, the beams 30, 32 flex inward as the protrusions 54, 56 engage the initiator connector housing 26. The inward movement of the beams 30, 32 allows the rests 34, 36 to move past their respective portions 38, 40 of the first connector housing 12, so that the CPA 14 can begin to reach a seated position. With the beams 30, 32 flexed inward so there is no interference between the rests 34, 36, and their respective portions 38, 40 of the first connector housing 12, the CPA 14 can be seated with an applied force of 22 N or less.

Each of the locking tabs 42, 44 includes first and second surfaces 58, 60 and 62, 64, respectively. The first surface 58, 62 of each of the locking tabs 42, 44 is sloped to facilitate movement of the CPA 14 toward its seated position. As shown in FIG. 3, the first connector housing 12, and in particular, the housing cover 16, includes first and second ledges 66, 68. The ledge 66 is defined by first and second surfaces 70, 72, while the second ledge 68 is defined by first and second surfaces 74, 76. The first surface 58 of the locking tab 42 is sloped so that it may easily slide over the first surface 70 of the ledge 66. Similarly, the first surface 62 of the locking tab 44 is also sloped so that it may easily slide over the first surface 74 of the ledge 68. Once the locking tabs 42, 44 are past their respective ledges 66, 68, the second surface 60, 64 of each of the locking tabs 42, 44 will automatically engage a respective second surface 72, 76 of the ledges 66, 68 as the beams 30, 32 flex back outward. As shown in FIG. 3, the second surface 60 of the locking tab 42 and the second surface 72 of the ledge 66 are generally parallel to each other, and generally perpendicular to the direction of an extraction force indicated by arrow 57. The second surface 64 of the locking tab 44 and the second surface 76 of the ledge 68 are similarly configured. This helps to ensure that the CPA 14 will not be disengaged merely by application of forces encountered during normal service.

Figure 4:
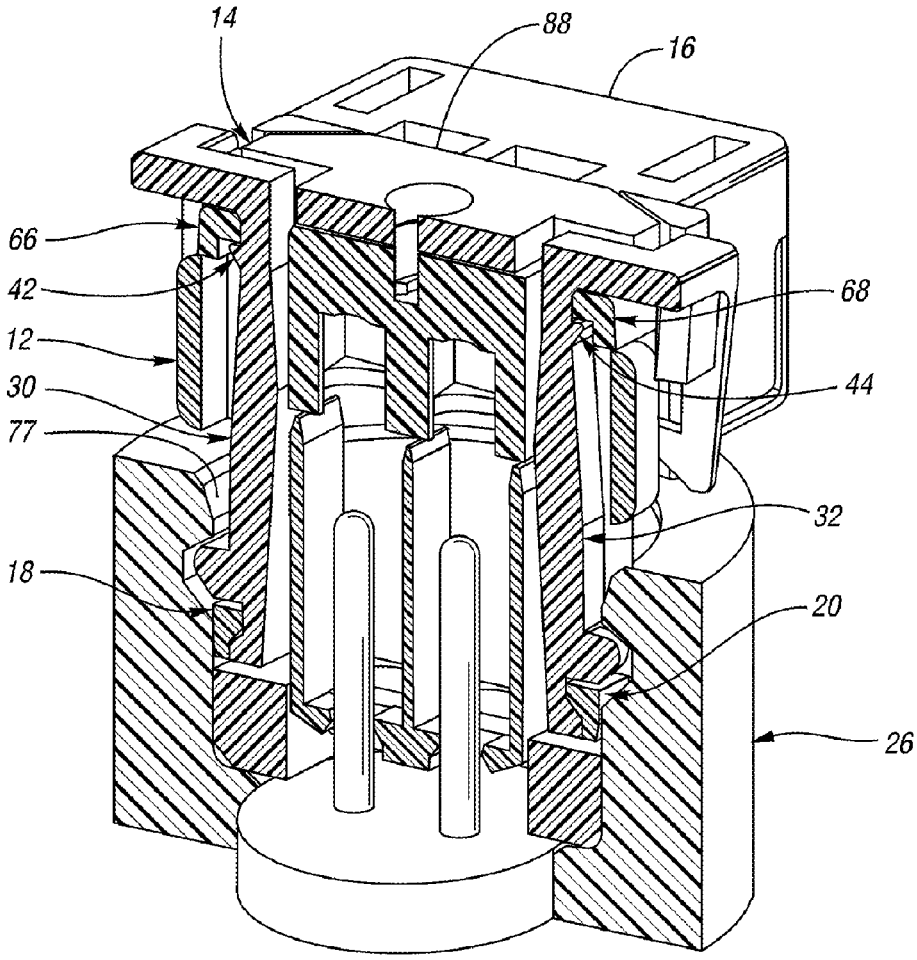
FIG. 4 is a sectional view of the electrical connector and initiator connector housing fully engaged with the CPA fully seated.

FIG. 4 shows the first connector housing 12 and the initiator connector housing 26 fully engaged in a mated position. Similarly, the CPA 14 is also seated. The locking tabs 42, 44 are now engaged with the ledges 66, 68 of the cover 16 of the first connector housing 12. In this position, an extraction force applied to the CPA 14 would need to severely deform or shear the locking tabs 42, 44 in order to move the CPA 14 from its seated position. In addition, the CPA 14 also helps to inhibit disengagement of the connector housings 12, 26, by inhibiting movement of the locking legs 18, 20 of the first connector housing 12. In order for the first connector housing 12 to disengage from the initiator connector housing 26, the locking legs 18, 20 must move inward enough so that the locking bumps 22, 24 can clear an inner edge 77 of the initiator connector housing 26. As shown in FIG. 4, the distal ends of the beams 30, 32 have enough clearance to flex inward a small distance. This distance, however, is not enough to allow the locking legs 18, 20 to move inward to allow disengagement of the first connector housing 12 from the initiator connector housing 26.

Figure 5:
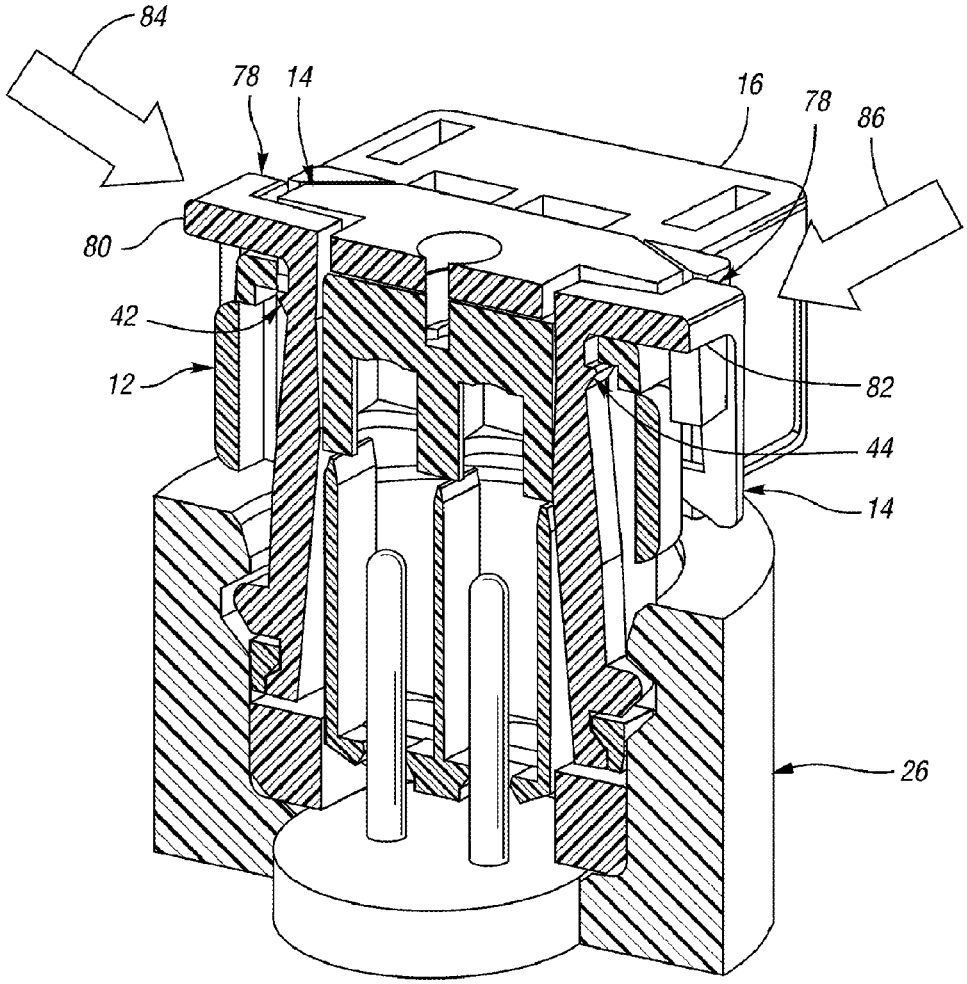
FIG. 5 is a sectional view of the electrical connector and initiator connector housing fully seated, and the release mechanism of the CPA actuated to facilitate unseating of the CPA.

As shown in FIG. 4, the engagement of the locking tabs 42, 44 with their respective ledges 66, 68 on the first connector housing 12, helps to ensure that the CPA 14 will not become unseated in the presence of extraction forces during normal service. It may be desirable, however, to disengage the connector housings 12, 26 from each other, and therefore, necessary to intentionally unseat the CPA 14. In order to accomplish this, the electrical connector 10 is provided with a release mechanism 78, shown in FIG. 5. The release mechanism 78 includes first and second portions, or actuators 80, 82, each of which is accessible from outside the first connector housing 12. An application of first and second predetermined forces to the first and second portions 80, 82, respectively, as indicated by the directional arrows 84, 86, will disengage the locking tabs 42, 44 from the first connector housing 12. Once the locking tabs 42, 44 are disengaged, the CPA 14 may be unseated by application of a force in a direction indicated by the arrow 57 in FIG. 3.

The configuration of the CPA 14, with its locking tabs 42, 44 disposed on flexible beams opposite each other, provides for a convenient one-handed removal. A technician can squeeze the first and second actuators 80, 82, and simultaneously apply an extraction force to unseat the CPA 14. Once the locking tabs 42, 44 are disengaged from the first connector housing 12, the CPA 14 can be unseated using an extraction force of less than 30 N. Conversely, if the release mechanism 78 is not actuated, and the locking tabs 42, 44 are engaged with the first connector housing 12, the CPA 14 will remain seated even in the presence of an extraction force of 110 N. Although hidden from view in FIG. 4, the beams 30, 32 are connected to a central portion 88 of the CPA 14 at points which are below the locking tabs 42, 44. Therefore, in the presence of an extraction force applied to the CPA 14, the beams 30, 32 pivot and flex outward at the locking tabs 42, 44, thereby further securing the CPA 14 to the first connector housing 12. This provides a connection for the CPA 14 to the first connector housing 12 that is substantially as strong as the connection between the connector housings 12, 26. Thus, the CPA 14 will remain seated even after the first stage of an airbag deployment.

Of course, the actual extraction force necessary to unseat the CPA 14, without actuation of the release mechanism 78, may be dependent on a number of factors, including the size of the locking tabs 42, 44, and the materials from which the CPA 14 is constructed. Although the CPA 14 may be made from any material effective to allow the CPA 14 to perform its intended functions, the CPA 14 can be conveniently molded from any of a number of polymeric materials. For example, polyamides (PA) and polybutylene terephthalate (PBT) have been shown to effective. Of course, stronger materials may also be stiffer, and having an appropriate flexibility in the beams 30, 32 is also desirable.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. An electrical connector including a first connector housing configured to cooperate with a second connector housing in a mated position to facilitate the making of an electrical connection, the electrical connector comprising:

a retainer configured to cooperate with the first connector housing in a first retainer position to allow engagement and disengagement of the first and second connector housings with each other, and further configured to cooperate with at least one of the connector housings in a second retainer position to inhibit disengagement of the first and second connector housings from the mated position, the retainer including:

a first locking feature configured to engage the first connector housing when the retainer is in the second retainer position for inhibiting movement of the retainer out of the second retainer position, and a release mechanism operable from outside the first connector housing to disengage the first locking feature from the first connector housing while the retainer is in the second retainer position to facilitate movement of the retainer out of the second retainer position.

2. The electrical connector of claim 1, wherein the retainer further includes a first beam having the first locking feature disposed thereon, and wherein the release mechanism cooperates with the first beam such that application of a first predetermined force on a first portion of the release mechanism moves the first beam to effect disengagement of the first locking feature from the first connector housing.

3. The electrical connector of claim 2, further comprising a second beam and a second locking feature disposed on the second beam, the second locking feature being configured to engage the first connector housing when the retainer is in the second retainer position for further inhibiting movement of the retainer out of the second retainer position, and wherein the release mechanism further cooperates with the second beam such that application of a second predetermined force on a second portion of the release mechanism moves the second beam to effect disengagement of the second locking feature from the first connector housing.

4. The electrical connector of claim 3, wherein each of the first and second locking features includes a respective locking tab configured to engage a respective ledge on the first connector housing, each of the locking tabs having a first surface oriented to facilitate sliding movement of the locking tab in a first direction past a respective ledge to dispose the retainer in the second retainer position, and each of the locking tabs having a second surface oriented to engage a respective ledge to inhibit sliding movement of the locking tab in a second direction generally opposite the first direction, thereby inhibiting movement of the retainer out of the second retainer position.

5. The electrical connector of claim 3, wherein each of the first and second beams includes a respective rest disposed thereon, each of the rests being configured to cooperate with a respective portion of the first connector housing to inhibit movement of the retainer from the first retainer position to the second retainer position when the first connector housing is disengaged from the second connector housing.

6. The electrical connector of claim 3, the first connector housing including first and second locking legs configured to engage a respective portion of the second connector housing when the first and second connector housings are in the mated position, wherein each of the first and second beams is configured to inhibit disengagement of a respective locking leg from the second connector housing when the retainer is in the second retainer position.

7. An electrical connector including a first connector housing configured to be engaged with a second connector housing in a mated position to facilitate the making of an electrical connection, the electrical connector comprising:

a connector position assurance device (CPA) positionable in a seated position for inhibiting disengagement of the connector housings from the mated position, the CPA including at least one locking tab selectively positionable in first and second positions when the CPA is in the seated position, the at least one locking tab in the first position engaging the first connector housing to inhibit movement of the CPA out of the seated position, the at least one locking tab in the second position being disengaged from the first connector housing to facilitate movement of the CPA out of the seated position, the at least one locking tab being movable from the first position to the second position while the CPA is in the seated position by application of a predetermined force on a portion of the CPA disposed outside the first connector housing.

8. The electrical connector of claim 7, wherein the CPA further includes at least one beam having a respective locking tab disposed thereon, the at least one beam being movable to facilitate movement of the respective locking tab between the first and second positions.

9. The electrical connector of claim 8, wherein the CPA further includes at least one actuator attached to a respective beam, the at least one actuator being operable from outside the first connector housing to effect movement of the respective beam to move the respective locking tab from the first position to the second position.

10. The electrical connector of claim 9, wherein the CPA is positionable in the seated position by movement of the CPA in a first direction relative to the first connector housing, and wherein the at least one locking tab is configured to:

slide over the first connector housing as the CPA is moved in the first direction toward the seated position, and automatically engage a respective portion of the first connector housing when the CPA reaches the seated position.

11. The electrical connector of claim 10, wherein the at least one locking tab includes first and second surfaces, the first surface of the at least one locking tab being oriented to slide over a respective first surface of the first connector housing when the CPA is moved in the first direction toward the seated position, the second surface of the at least one locking tab being configured to cooperate with a respective second surface of the first connector housing when the CPA is in the seated position to inhibit movement of the CPA out of the seated position.

12. The electrical connector of claim 11, wherein the second surface of the at least one locking tab and the second surface of the first connector housing are oriented generally parallel to each other and generally perpendicular to the first direction when the CPA is in the seated position.

13. The electrical connector of claim 12, wherein the at least one beam includes a rest disposed thereon, the rest being configured to cooperate with a respective portion of the first connector housing to inhibit movement of the CPA into the seated position when the first and second connector housings are disengaged from each other.

14. A vehicle airbag apparatus, comprising:

an initiator having an initiator connector housing attached thereto;

a first connector housing configured to cooperate with the initiator connector housing in a mated position for making an electrical connection with the initiator; and a retainer movable between a first retainer position which facilitates movement of the first connector housing into and out of the mated position and a second retainer position which inhibits movement of the first connector housing out of the mated position, the retainer including a locking feature configured to engage the first connector housing to inhibit movement of the retainer out of the second retainer position, the retainer further including a release mechanism operable from outside the first connector housing to disengage the locking feature from the first connector housing while the retainer is in the second retainer position to facilitate movement of the retainer out of the second retainer position.

15. The airbag apparatus of claim 14, wherein the retainer further includes a beam having the locking feature disposed thereon, and wherein the release mechanism cooperates with the beam such that application of a first predetermined force on a portion of the release mechanism moves the beam to effect disengagement of the locking feature from the first connector housing.

16. The airbag apparatus of claim 15, wherein the retainer further includes a second beam and a second locking feature disposed on the second beam, the second locking feature being configured to engage the first connector housing when the retainer is in the second retainer position for further inhibiting movement of the retainer out of the second retainer position, and wherein the release mechanism further cooperates with the second beam such that application of a second predetermined force on a second portion of the release mechanism moves the second beam to effect disengagement of the second locking feature from the first connector housing.

17. The airbag apparatus of claim 16, wherein each of the first and second locking features includes a respective locking tab configured to engage a respective ledge on the first connector housing, each of the locking tabs having a first surface oriented to facilitate sliding movement of the locking tab in a first direction past a respective ledge to dispose the retainer in the second retainer position, and each of the locking tabs having a second surface oriented to engage a respective ledge to inhibit sliding movement of the locking tab in a second direction generally opposite the first direction, thereby inhibiting movement of the retainer out of the second retainer position.

18. The airbag apparatus of claim 17, wherein the first and second locking tabs are configured to maintain the retainer in the second retainer position when the locking tabs are engaged with the first connector housing and a force of 100 Newtons is applied to the retainer in the second direction.

19. The airbag apparatus of claim 18, wherein the retainer is configured to be moved out of the second retainer position when the locking tabs are disengaged from the first connector housing and a force of less than 30 Newtons is applied to the retainer in the second direction.

20. The airbag apparatus of claim 19, wherein the first connector housing includes first and second locking legs configured to engage a respective portion of the second connector housing when the first and second connector housings are in the mated position, and wherein each of the first and second beams is configured to inhibit disengagement of a respective locking leg from the second connector housing when the retainer is in the second retainer position.

* * * * *